US006793710B2

(12) United States Patent
Sumi et al.

(10) Patent No.: US 6,793,710 B2
(45) Date of Patent: Sep. 21, 2004

(54) METHOD FOR BLOWING OXYGEN IN CONVERTER AND TOP-BLOWN LANCE FOR BLOWING OXYGEN

(75) Inventors: Ikuhiro Sumi, Fukuyama (JP); Yoshiteru Kikuchi, Fukuyama (JP); Ryo Kawabata, Fukuyama (JP); Atsushi Watanabe, Fukuyama (JP); Shinichi Akai, Fukuyama (JP); Satoshi Kohira, Fukuyama (JP)

(73) Assignee: NKK Corporation, Tokyo (JP)

( * ) Notice: Subject to any disclaimer, the term of this patent is extended or adjusted under 35 U.S.C. 154(b) by 9 days.

(21) Appl. No.: 10/183,753

(22) Filed: Jun. 27, 2002

(65) Prior Publication Data

US 2003/0010155 A1 Jan. 16, 2003

Related U.S. Application Data

(63) Continuation of application No. PCT/JP01/09971, filed on Nov. 15, 2001.

(30) Foreign Application Priority Data

Nov. 16, 2000 (JP) ..... 2000-349746
Sep. 28, 2001 (JP) ..... 2001-302591

(51) Int. Cl.[7] ..... C21C 5/32
(52) U.S. Cl. ..... 75/553; 266/225
(58) Field of Search ..... 75/553; 266/225

(56) References Cited

U.S. PATENT DOCUMENTS 5,540,753 A * 7/1996 Takano et al. ..... 75/551
6,284,016 B1 * 9/2001 Kitamura et al. ..... 75/378

FOREIGN PATENT DOCUMENTS

JP 6-228624 A 8/1994
JP 9-209021 A 8/1997
JP 10-20110 A 2/1998

* cited by examiner

*Primary Examiner*—Melvyn Andrews
(74) *Attorney, Agent, or Firm*—Frishauf, Holtz, Goodman & Chick, P.C.

(57) ABSTRACT

A method for blowing oxygen in a converter uses a top-blown lance having a Laval nozzle installed on its tip. The Laval nozzle has a back pressure of the nozzle Po(kPa) satisfying a formula, $Po=Fh_S/(0.00465\cdot Dt^2)$, with respect to a oxygen-flow-rate $Fh_S(Nm^3/hr)$ per hole of the Laval nozzle determined from the oxygen-flow-rate $F_S(Nm^3/hr)$ in a high carbon region in a peak of decarburization and a throat diameter Dt(mm). An exit diameter De of the Laval nozzle satisfies the following formula with respect to the back pressure of the nozzle Po(kPa), an ambient pressure Pe(kPa), and the throat diameter Dt(mm):

$$De^2 \leqq 0.23 \times Dt^2 / \{(Pe/Po)^{5/7} \times [1-(Pe/Po)^{2/7}]^{1/2}\}.$$

16 Claims, 2 Drawing Sheets

METHOD FOR BLOWING OXYGEN IN CONVERTER AND TOP-BLOWN LANCE FOR BLOWING OXYGEN

This application is a continuation patent application of International Application PCT/JP01/09971) filed Nov. 15, 2001.

FIELD OF THE INVENTION

The present invention relates to a method for blowing oxygen in a converter to refine a molten iron and a top-blown lance for blowing oxygen in the converter.

DESCRIPTION OF RELATED ARTS

In blowing oxygen into a molten iron in a converter, an oxidation refining is carried out with top-blown oxygen or bottom-blown oxygen mainly for decarburization. In recent years, there is an increased demand for refining a large amount of molten iron in a shorter period of time and achieving a high productivity, than ever before. Further, more oxygen source is required to directly reduce a large amount of iron ore or manganese ore and to melt a large amount of iron scrap in the converter. To this end, a technique, which enables a precise control of composition while blowing a large amount of oxygen stably in a short period of time, is required. Moreover, development of a pretreatment process for the molten iron for the purpose of dephosphorization and desulfurization of the molten iron has drastically reduced the amount of slag generated in the converter refining, and many factors different from those in the conventional process have arisen. To meet such situation, an immediate optimization of the oxygen blowing method in the converter is now an urgent matter.

In the oxidation refining with the top-blown lance, the oxygen is supplied from a divergent nozzle, known as Laval nozzle, installed on a tip of the top-blown lance into the converter as a supersonic or a subsonic jet. In this case, a shape of the Laval nozzle is designed generally depending on the refining conditions in a high carbon region from the beginning to the middle of the blow process in which comparatively much oxygen is supplied to prevent a decline of efficiency of reactions such as the decarburization reaction. Hereinafter, the amount of the supplied oxygen is referred to as "oxygen-flow-rate." In Mother words, in case of the high oxygen-flow-rate, the blown oxygen is expanded properly to be supersonic-like by the Laval nozzle, on the contrary, in case of the low oxygen-flow-rate, corresponding to the low carbon region in the end of the blow, the oxygen expands excessively within the Laval nozzle, resulting in keeping the oxygen from being supersonic-like. In the high carbon region from the beginning to the middle of the blow, molten pool contains over about 0.6 mass % of C, and in the low carbon region in the end of the blow, the molten pool contains about 0.6 mass % or less of C.

When the Laval nozzle based on such design concept is applied to the oxygen blowing method having the still higher oxygen-flow-rate aiming to achieve a high productivity, a jet flow velocity of the oxygen jet supplied from the top-blown lance is further increased, the flow velocity of the jet reaching a surface of the molten pool within the converter is increased and a surface of the molten metal fluctuates more vigorously. In the conventional blow with large amount of the slag of more than 50 kg per ton of molten steel, this design concept was crucial to ensure the oxygen jet to penetrate through the slag layer.

However, in the blow with a small amount of the slag such as those in recent days, such design concept becomes less necessary, contrarily, in the blow with a small amount of slag, the fluctuation of the surface of the pool accompanying the increase of the jet flow velocity causes vigorous scatter of the molten pool including spitting and splashing and increases metal adhesion to regions such as a throat and a hood, the top-blown lance, and equipment for off gas besides, thereby affects adversely on operation and causes a waning productivity due to the decline of yield of iron. Moreover, iron dust increases significantly with the scatter, leading to a decline of the yield of iron also from a viewpoint of the dust.

To restrain such deterioration of the operating conditions, a number of measures, in which the operation conditions including a distance between the tip of the top-blown lance and a bath surface and the oxygen-flow-rate are controlled, have been proposed, with hardware of the top-blown lance including a hole size and bevel of the Laval nozzle being optimized. Hereinafter, the distance between the tip of the top-blown lance and the bath surface is written as "lance-height ". For example, JP-A-6-228624 discloses the blow method in which the shape of the top-blown lance is optimized, and the oxygen-flow-rate and the lance-height are controlled within a proper range adapted for the shape of the Laval nozzle. However, if a structure of the Laval nozzle and the lance-height are altered to restrain the scatter of iron and the dust during the increased flow as described in that number of the publication, a trace and geometry of the oxygen jet brown out from the top-blown lance are extremely changed, therefore secondary adverse affects, such as an unnecessary post combustion and the decline of the reaction efficiency due to the fluctuation of the reaction interface area, occur. Moreover, if the alteration of the lance-height and the like are hard physically or operationally, the measure cannot be advantageous.

On the other hand, in the low carbon region in the end of the blow, since the supplied oxygen is also consumed in the oxidization of the iron as well as the decarburization, the oxygen-flow-rate is reduced to restrain the oxidization of the iron and improve the oxygen efficiency for the decarburization. In this case, the oxygen-flow-rate greatly deflects downward from an optimum flow value of the Laval nozzle, therefore maximum effect of the Laval nozzle cannot be obtained, and the oxygen jet is attenuated unnecessarily, resulting in the decline of the efficiency of the decarburization in the end of the blow, as indicated in increased T.Fe in the slag. Moreover, although the oxygen-flow-rate must be controlled in extremely low order in the end of the blow in order to improve a hitting accuracy of the composition at the endpoint of the blow, an excessively low order of the rate extremely reduces dynamic pressure of the oxygen and causes rapid oxidization of the iron, therefore the oxygen-flow-rate has its limit in reduction. It is noted that the T.Fe is a total value of the iron content in all of the iron oxides including FeO and $Fe_2O_3$ in the slag.

Japanese unexamined patent publication No.10-30110 discloses the oxygen blowing method which employs the top-blown lances having an exit diameter from 0.85 D to 0.94 D in the high carbon region and the exit diameter from 0.96 D to 1.15 D in the low carbon region respectively, to an optimum expansion exit diameter D of the Laval nozzle determined from the throat diameter of the Laval nozzle and the oxygen-flow-rate. The Publication also describes that even when the same Laval nozzle is used, the exit diameter can be adjusted satisfying the above described range to the optimum expansion exit diameter D by altering the oxygen-flow-rate and a back pressure of the Laval nozzle P.

In Japanese unexamined patent publication No.10-30110, it is described that a soft blow can be achieved in the high carbon region, and a hard blow can be achieved in the low carbon region by altering the shape of the Laval nozzle as above, and the reduction of the dust and the reduction of iron oxidization can be achieved at the same time. However, in this blow method, two or more types of the top-blown lances, each lance having different shape, must be used to control the refining surely, and certain complexity in equipment and operation can not be disregarded. In addition, when the same single top-blown lance is used, some problems may occur, that is, design of the Laval nozzle becomes complicated, and the oxygen-flow-rate cannot be altered freely depending on the conditions within the converter. Moreover, for an application in the minimum amount of the slag, many unclear points still remain.

SUMMARY OF THE INVENTION

It is an object of the present invention to provide an oxygen blowing method in a converter wherein the scatter of the iron and the generation of the dust are reduced at the high-oxygen-flow-rate period in the high carbon region as a peak of the decarburization, the oxidization of the iron is restrained at the low-oxygen-flow-rate period in the end of the oxygen blowing, and the reaction is stably performed at the low oxygen-flow-rate.

To achieve the object, the present invention provides an oxygen blowing method in a converter, which uses a top-blown lance having a Laval nozzle installed at the tip of the top-blown lance.

The Laval nozzle has a back pressure of the nozzle Po(kPa) satisfying the following formula with respect to the oxygen-flow-rate Fhs($Nm^3$/hr) per hole of the Laval nozzle, determined from the oxygen-flow-rate Fs($Nm^3$/hr) in a high carbon region as a peak of the decarburization, and a throat diameter Dt(mm).

$$Po=Fhs/(0.00465\cdot Dt^2)$$

An exit diameter De of the Laval nozzle satisfies the following formula with respect to the back pressure of the nozzle Po(kPa), an ambient pressure Pe(kPa), and the throat diameter Dt(mm).

$$De^2 \leqq 0.23\times Dt^2/\{(Pe/Po)^{5/7}\times[1-(Pe/Po)^{2/7}]^{1/2}\}$$

It is preferable in the oxygen blowing method that the exit diameter De of the Laval nozzle satisfies the following formula with respect to the back pressure of the nozzle Po(kPa), the ambient pressure Pe(kPa), and the throat diameter Dt(mm).

$$De^2 \leqq 0.185\times Dt^2/\{(Pe/Po)^{5/7}\times[1-(Pe/Po)^{2/7}]^{1/2}\}$$

Further, it is more preferable that the exit diameter De of the Laval nozzle satisfies the following formula with respect to the back pressure of the nozzle Po(kPa), the ambient pressure Pe(kPa), and the throat diameter Dt(mm).

$$0.15\times Dt^2/\{(Pe/Po)^{5/7}\times[1-(Pe/Po)^{2/7}]^{1/2}\} \leqq De^2 \leqq 0.18\times Dt^2/\{(Pe/Po)^{5/7}\times[1-(Pe/Po)^{2/7}]^{1/2}\}$$

In the oxygen blowing method, the top-blown lance has multiple Laval nozzles, and at least one of those Laval nozzles is required to satisfy conditions of the following two formulas.

$$Po=Fhs/(0.00465\cdot Dt^2)$$

$$De^2 \leqq 0.23\times Dt^2/\{(Pe/Po)^{5/7}\times[1-(Pe/Po)^{2/7}]^{1/2}\}$$

More preferably, the conditions of the following two formulas are satisfied.

$$Po=Fhs/(0.00465\cdot Dt^2)$$

$$De^2 \leqq 0.185\times Dt^2/\{(Pe/Po)^{5/7}\times[1-(Pe/Po)^{2/7}]^{1/2}\}$$

In the oxygen blowing method, it is preferable that the oxygen blowing is carried out at the amount of the slag of less than 50 kg per ton of the molten steel. More preferably, the amount is less than 30 kg per ton of the molten steel.

Moreover, in the oxygen blowing method, the Laval nozzle has the back pressure of the nozzle Poo(kPa), satisfying the following formula with respect to the oxygen-flow-rate $Fh_M$ ($NM^3$/hr) per hole of the Laval nozzle determined from the oxygen-flow-rate $F_M$($Nm^3$/hr) in the low carbon region in the end of the blow, and the throat diameter Dt (mm).

$$Poo=Fh_M/(0.00465\cdot Dt^2)$$

It is desirable that the exit diameter De has a ratio (De/Deo) of 1.10 or less to the optimum exit diameter $De_o$(mm) which is given from the back pressure Poo(kPa), the ambient pressure Pe(kPa), and the throat diameter Dt(mm) according to the following formula.

$$De_o^2=0.259\times Dt^2/\{(Pe/Poo)^{5/7}\times[1-(Pe/Poo)^{2/7}]^{1/2}\}$$

Further, this invention provides the oxygen blowing method that blows using the top-blown lance having the Laval nozzle installed on its tip.

The Laval nozzle has the back pressure of the nozzle Poo(kPa) satisfying the following formula with respect to the oxygen-flow-rate $Fh_M$($Nm^3$/hr) per hole of the Laval nozzle determined from the oxygen-flow-rate $F_M$($NM^3$/hr) in the low carbon region in the end of the blow, and the throat diameter Dt(mm).

$$Poo=Fh_M/(0.00465\cdot Dt^2)$$

The exit diameter De of the Laval nozzle has the ratio (De/Deo) of 0.95 or less to the optimum exit diameter $De_o$(mm) which is given from the back pressure Poo(kPa), the ambient pressure Pe(kPa), and the throat diameter Dt(mm) according to the following formula.

$$De_o^2=0.259\times Dt^2/\{(Pe/Poo)^{5/7}\times[1-(Pe/Poo)^{2/7}]^{1/2}\}$$

In the oxygen blowing method, the top-blown lance has the multiple Laval nozzles, and at least one of those Laval nozzles is required to satisfy the conditions of the following two formulas.

$$Poo=Fh_M/(0.00465\cdot Dt^2)$$

$$De^2=0.259\times Dt^2/\{(Pe/Poo)^{5/7}\times[1-(Pe/Poo)^{2/7}]^{1/2}\}$$

In the oxygen blowing method, it is preferable that the oxygen blowing is done at the amount of the slag of less than 50 kg per ton of the molten steel. More preferably, the amount is less than 30 kg per ton of the molten steel.

Further, the present invention provides a top-blown lance for blowing oxygen having the Laval nozzle installed on its tip.

The Laval nozzle has the back pressure of the nozzle Po(kPa) satisfying the following formula with respect to the oxygen-flow-rate Fhs($Nm^3$/hr) per hole of the Laval nozzle determined from the oxygen-flow-rate Fs($Nm^3$/hr) in the high carbon region as the peak of the decarburization, and the throat diameter Dt(mm).

$$Po=Fhs/(0.00465\cdot Dt^2)$$

The exit diameter De of the Laval nozzle satisfies the following formula with respect to the back pressure of the nozzle Po(kPa), the ambient pressure Pe(kPa), and the throat diameter Dt(mm).

$$De^2=0.23\times Dt^2/\{(Pe/Poo)^{5/7}\times[1-(Pe/Poo)^{2/7}]^{1/2}\}$$

Further, the present invention provides the top blown lance for blowing oxygen having the Laval nozzle installed on its tip.

The Laval nozzle has the back pressure of the nozzle Poo(kPa) satisfying the following formula with respect to the oxygen-flow-rate $Fh_M$($Nm^3$/hr) per hole of the Laval nozzle determined from the oxygen-flow-rate $F_M$($Nm^3$/hr) in the low carbon region in the end of the blow, and the throat diameter Dt(mm).

$$Poo=Fh_M/(0.00465\cdot Dt^2)$$

The exit diameter De of the Laval nozzle has the ratio (De/Deo) of 0.95 or less to the optimum exit diameter $De_o$(mm) which is given from the back pressure of the nozzle Poo(kPa), the ambient pressure Pe(kPa), and the throat diameter Dt(mm) according to the following formula.

$$De_o^2=0.259\times Dt^2/\{(Pe/Poo)^{5/7}\times[1-(Pe/Poo)^{2/7}]^{1/2}\}$$

EMBODIMENT FOR CARRYING OUT THE INVENTION

Figure 1:
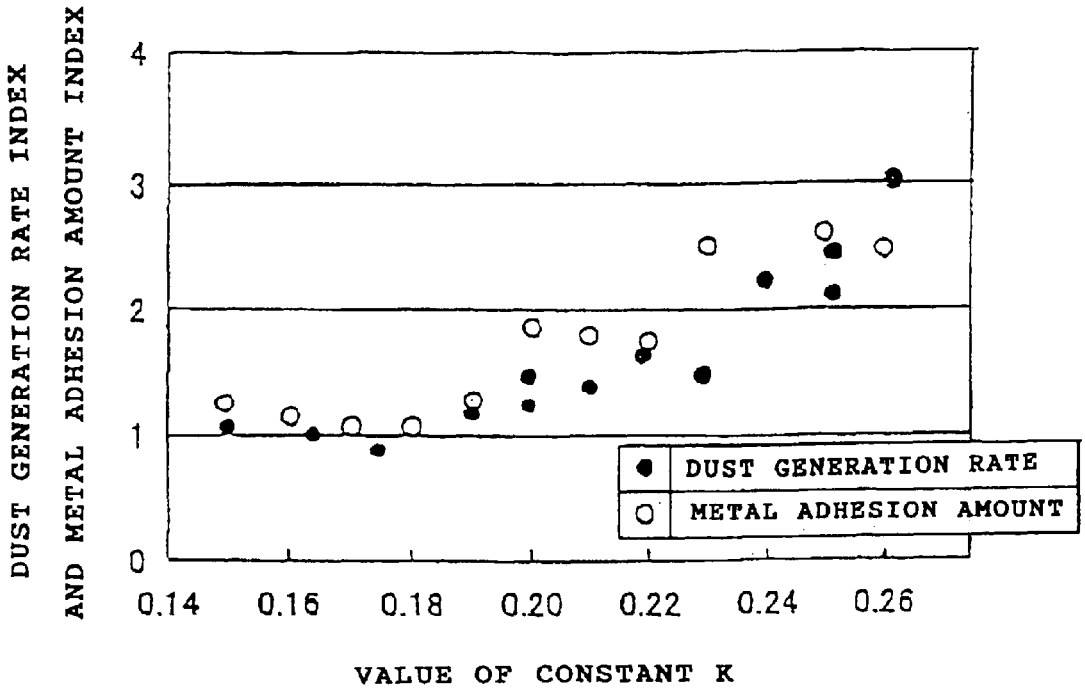
FIG. 1 is a view showing a relationship between the dust generation rate and the metal adhesion amount in the peak of the decarburization, and a constant K.

The inventors attained to the knowledge that the difficulties in prior art can be solved by using the Laval nozzle having the extremely smaller exit diameter De than the size De designed based on the conditions at the high oxygen-flow-rate in the high carbon region in the peak of the decarburization. Hereinafter, results of study will be described.

Behavior in converter during the oxygen blowing is divided roughly into the behavior in the high carbon region (C>0.6 mass %) and the behavior in the low carbon region (C≦0.6 mass %) due to difference of their reaction behavior. In the high carbon region, almost whole quantity of the supplied oxygen is consumed in the decarburization, a limiting factor of the reaction is the oxygen-flow-rate, and the blow is done at the high oxygen-flow-rate. On the other hand, in the low carbon region, the limiting factor is changed from the oxygen-flow-rate to the carbon-migration-rate, and the oxygen is also consumed partially in the oxidization of the iron, therefore the oxygen-flow-rate is reduced to restrain the iron oxidization and improve the oxygen efficiency for the decarburization.

In this occasion, in the blow in the high carbon region, the dynamic pressure of the oxygen jet at the surface of the molten pool must be lowered, while the high oxygen-flow-rate is maintained in order to reduce the scatter of the iron and the dust. However, in order to avoid the unnecessary post combustion and keep the high order of oxygen efficiency for the decarburization, the geometry and the trajectory of the oxygen jet must be kept in constant conditions as much as possible. On the other hand, in the low carbon region, although the oxygen-flow-rate is reduced to improve the oxygen efficiency for the decarburization, accordingly the dynamic pressure of the oxygen jet is significantly reduced, therefore the decline of the oxygen efficiency for the decarburization or increase of the oxidization of the iron is brought about if as it is. Moreover, the decline becomes more significant as the oxygen-flow-rate is reduced more. As a result, although it is desired that the dynamic pressure of the oxygen jet at the surface of the bath is kept in the high order as much as possible, there is a limit in increasing the dynamic pressure of the oxygen jet by means of lowering of the lance-height, because the means causes wear of the tip of the top-blown lance due to radiation from the bath surface and the metal adhesion to the lance due to the scatter of the iron from the surface to be increased significantly. In this way, there are conflicting requirements between the high carbon region and the low carbon region, besides, the measures must be practiced without alteration of the operating conditions such as the lance-height as much as possible.

The Laval nozzle in the oxygen blowing of the converter is designed based on the oxygen-flow-rate, and generally based on the oxygen-flow-rate in the high carbon region from the beginning to the middle of the blow. That is, the Laval nozzle is designed by determining the back pressure of the nozzle Po(kPa) from the oxygen-flow-rate per hole of the Laval nozzle $Fh_S$($Nm^3$/hr) given from the oxygen-supplying-rate $F_S$($Nm^3$/hr) in the high carbon region and the throat diameter Dt(mm) according to the following formula (1), and then determining the exit diameter De(mm) using the determined back pressure of the nozzle Po(kPa), the ambient pressure Pe(kPa), and the throat diameter Dt(mm) according to the following formula (5);

$$Po=Fhs/(0.00465\cdot Dt^2) \quad (1)$$

$$De^2+K\times Dt^2/\{(Pe/Po)^{5/7}\times[1-(Pe/Po)^{2/7}]^{1/2}\} \quad (5)$$

where, the oxygen-flow-rate Fh per hole of the Laval nozzle can be given by multiplying the ratio of a section area of an individual throat diameter Dt of the Laval nozzle to the total section area of the throat diameter Dt of the Laval nozzle and the oxygen-flow-rate F, and generally, in case the multiple Laval nozzles are installed, the oxygen-flow-rate Fh can be given from dividing the oxygen-flow-rate F by number of the installed Laval nozzles because each throat diameter Dt of the Laval nozzle is assumed to be substantially equal. In addition, the ambient pressure Pe is that outside of the Laval nozzle, in other words, the ambient gas pressure within the converter. It is noted that formula (1) and formula (5) are relational expressions formable in the Laval nozzle, and well known as the formulas used in the design of the Laval nozzle. K in the formula (5) is a constant.

In this occasion, while the constant K in the formula (5) is given to be 0.259 theoretically, it is rare in a practical operation that the ratio of the oxygen-flow-rate F to the back pressure of the nozzle Po (F/Po) is maintained constantly, in many cases, the ratio (F/Po) is controlled in the operation such that the constant K generally lies in a range from 0.24 to 0.28. In the Laval nozzle, of which exit diameter De is determined assuming the constant K is 0.24 to 0.28, the oxygen jet expands substantially optimumly, and energy of the oxygen jet itself is maximum. Therefore, the energy of the oxygen jet reaching the bath surface is also maximum, leading to increase of the scatter of the iron and the dust.

On the other hand, when the blow process is advanced to the low carbon region, the oxygen-flow-rate is reduced gradually as described before, however, if such conventional Laval nozzle is used, since the nozzle is designed based on the high oxygen-flow-rate in the high carbon region, excessively low oxygen-flow-rate causes the oxygen jet to be attenuated intensively, the blow falls to be extremely unstable due to the decline of the reaction efficiency for the decarburization or the oxidization of the iron, and the hitting accuracy of the composition of the molten pool in the end of the blow declines drastically.

In this way, if the conventional Laval nozzle based on the high oxygen-flow-rate is used, the reaction in the end of the blow tend to be unstable, in addition, there is the lower limit in a percentage of the reduction of the oxygen-flow-rate in the end of the blow to the oxygen-flow-rate in the high carbon region, and the significant decline of the hitting percentage of the composition in the end of the blow is brought about in the oxygen-flow-rate of the lower limit or less.

Therefore, to overcome these problems, the inventors studied the behavior in the oxygen blowing in the peak of the decarburization and the end of the blow using the Laval nozzle of which exit diameter De is different from the conventional De, while throat diameter Dt is equal to the conventional Dt. Specifically, the exit diameter De is determined as bellow. That is, the back pressure of the nozzle Po was given from the oxygen-flow-rate $Fh_S$ in the high carbon region and the throat diameter Dt according to the formula (1), and when the exit diameter De was given from the obtained back pressure of the nozzle Po, the ambient pressure Pe, and the throat diameter Dt according to the formula (5), the constant K was varied differently from 0.15 to 0.26, then the exit diameter De was determined. As the constant K becomes smaller below 0.26, the exit diameter De becomes smaller, and the oxygen jet within the Laval nozzle expands insufficiently. It is noted that the used converters are those shown in the practical examples as described later.

FIG. 1 shows the results of the study on relations between the dust generation rate and the amount of the metal adhesion in the peak of the decarburization, and the constant K, in the blows. As shown in FIG. 1, when the constant K is about 0.23 or less, the dust generation rate is in low order together with the amount of the metal adhesion. That is, it was known that the dust generation rate and the amount of the metal adhesion are reduced together by establishing the exit diameter De in the range According to the following formula (2). If the constant K is 0.185 and below, the dust generation rate and the amount of the metal adhesion are further reduced. Most preferably, the constant K is in the range from 0.15 to 0.18. It is considered that the reason is because the oxygen jet expands short within the Laval nozzle at the high oxygen-flow-rate in the high carbon region by establishing the exit diameter De to be smaller than a theoretical value (in case of K=0.259), and thus the jet flow of the oxygen jet is attenuated and the kinetic energy of the oxygen jet at the pool surface is reduced. In this occasion, although effect on the attenuation of the jet increases with decrease of the constant K, practically the constant K becomes its lower limit when the exit diameter De agrees with the throat diameter Dt.

$$De^2 \leqq 0.23 \times Dt^2 / \{(Pe/Po)^{5/7} \times [1-(Pe/Po)^{2/7}]^{1/2}\} \quad (2)$$

On the other hand, in the low carbon region in the end of the blow, the energy of the oxygen jet must be increased while the oxygen-flow-rate is suppressed, in order to reduce the T.Fe and accelerate and/or stabilize the refining reaction. If the Laval nozzle, of which exit diameter De is established to be small compared with the theoretical value given from the oxygen-flow-rate in the high carbon region as the peak of the decarburization, or designed assuming that the constant K is lower than 0.259, is used, while the oxygen jet expands insufficiently in the peak of the decarburization as the exit diameter De is smaller, the jet necessarily approaches the optimum expansion jet flow at the low oxygen-flow-rate in the end of the blow, the energy of the oxygen jet increases without any particular means, and the reduction of the T.Fe and acceleration and/or stabilization of the refining reaction can be achieved by the effect for improvement of the refining reaction due to the increased oxygen jet energy.

To maximize the effect for the improvement, it is simply required that the optimum expansion jet flow can be obtained at the oxygen-flow-rate in the end of the blow. To this end, it is simply required that the back pressure of the nozzle Poo (kPa) is given from the oxygen-flow-rate $Fh_M$ ($Nm^3$/hr) per hole of the Laval nozzle in the end of the blow process in the blow concerned and the predetermined throat diameter Dt(mm) of the Laval nozzle according to the following formula (3), the optimum exit diameter $De_o$(mm) in the end of the blow is given using the the back pressure of the nozzle Poo(kPa), the throat diameter Dt(mm), and the ambient pressure Pe kPa) according to the following formula (4), and the obtained optimum exit diameter $De_o$ is agreed with the exit diameter De of the Laval nozzle concerned.

$$Poo = Fh_M / (0.00465 \cdot Dt^2) \quad (3)$$

$$De_o^2 = 0.259 \times Dt^2 / \{(Pe/Poo)^{5/7} \times [1-(Pe/Poo)^{2/7}]^{1/2}\} \quad (4)$$

Figure 2:
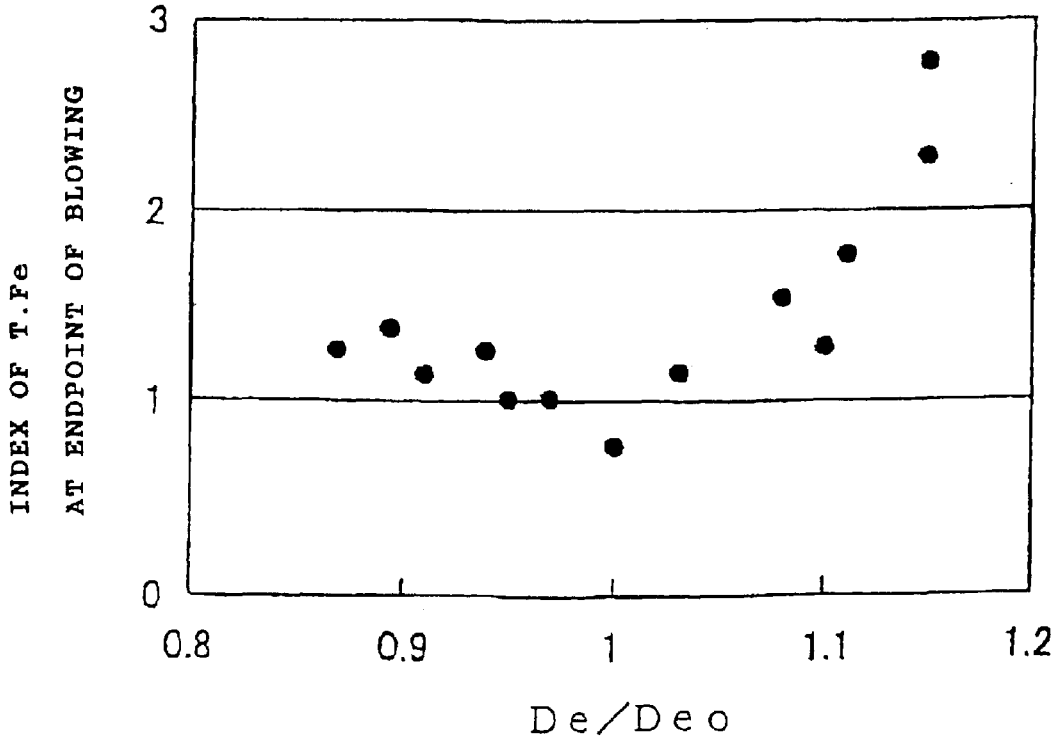
FIG. 2 is the view showing the relationship between the ratio of an actual hole size De to the optimum hole size $De_o$ and the T.Fe at the endpoint of the blow.

However, in fact, it is often difficult to constantly agree the optimum exit diameter $De_o$ given as above with the actual exit diameter De. Therefore, an investigation was done on what range of the $De/De_o$ as the ratio of those is effective in the reduction of the T.Fe. The investigation was carried out using the aforementioned converter. FIG. 2 shows the investigation results.

FIG. 2 is a view showing the ratio of the exit diameter of the used nozzle De to the optimum exit diameter $De_o$ calculated from the conditions in the end of the blow in the practical operation as a horizontal axis and the T.Fe at the endpoint of the blow along a vertical axis. As seen clearly in FIG. 2, it was known that if the ratio of the exit diameter of the used nozzle De to the calculated optimum exit diameter Deo ($De/De_o$) ranges not more than 1.10, the T.Fe can be suppressed low compared with the conventional level. Further, from a large number of test results, the significant effect in the reduction of the T.Fe, or a preferable effect was obtained in the range of the $De/De_o$ from 0.90 to 1.05. This effect was particularly significant in case the exit diameter De was established to be within the range according to the aforementioned formula (2). The effect is more significant when the constant K is not more than 0.18 and the amount of the slag is less than 50 kg, and desirably less than 30 kg, per ton of the molten steel.

In this case, particularly when the $De/De_o$ is not more than 0.95, the effect for the attenuation of the oxygen jet in the peak of the decarburization is necessarily increased, in addition, the effect on the decarburization reaction in the end can be kept in that range, and the effect for the attenuation of the jet flow can be obtained in some degree, therefore the metal adhesion to the lance was restrained in extremely low order over the whole region in the blow, as well as the effect for the reduction of the T.Fe. These effects were obtained not always by establishing the exit diameter De to be within the range according to the formula (2), and only establishing the $De/De_o$ to be not more than 0.95.

In the oxygen blowing in the converter, when the amount of the slag is small within the converter, the percentage of the molten pool that is covered by the slag decreases, and the amount of the dust and the scatter of the iron in the high carbon region increases. The aforementioned oxygen blowing method can restrain the amount of the dust and the scatter of the iron. Moreover, in the low carbon region in the end of the blow, since factors for interfering the dynamic pressure of the jet also decrease in case of the small amount of the slag, the effects can be obtained in a wide control range. Therefore, the effects can be brought out more significantly by applying the above oxygen blowing method to the blow where the amount of the slag within the converter is less than 50 kg, and desirably less than 30 kg, per ton of the molten steel.

The present invention is made based on the above knowledge, and the oxygen blowing method in the converter according to the embodiment 1-1 is characterized in that; employing the top-blown lance having the Laval nozzle installed on its tip; determining the back pressure of the nozzle Po(kPa) satisfying the above formula (1) with respect to the oxygen-flow-rate $Fh_S(Nm^3/hr)$ per hole of the Laval nozzle determined from the oxygen-flow-rate $F_S(Nm^3/hr)$ in the high carbon region as the peak of the decarburization and the throat diameter Dt(mm) of the Laval nozzle, in the oxygen blowing method blowing at various different oxygen-flow-rate depending on a carbon concentration of the molten pool; and blowing using the top-blown lance provided with the Laval nozzle having the exit diameter De(mm) obtained from the back pressure of the nozzle Po(kPa), the ambient pressure Pe(kPa), and the throat diameter Dt(mm) according to the above formula (2).

The oxygen blowing method in the converter according to the embodiment 1-2 is characterized in that; the exit diameter De further lies in the range that the ratio to the optimum exit diameter $De_o$(mm) ($De/De_o$) is not more than 1.10 in the embodiment 1-1; the $De_o$ being obtained from the back pressure of the nozzle Poo(kPa) satisfying the above formula (3) with respect to the oxygen-flow-rate $Fh_M(Nm^3/hr)$ per hole of the Laval nozzle determined from the oxygen-flow-rate $F_M(Nm^3/hr)$ in the low carbon region in the end of the blow and the throat diameter Dt(mm), the ambient pressure Pe(kPa), and the throat diameter Dt(mm) according to the above formula (4).

The oxygen blowing method in the converter according to the embodiment 1-3 is characterized in that; in the oxygen blowing method which employs the top-blown lance having the Laval nozzle installed on its tip and blows at various different oxygen-flow-rates depending on the carbon concentration of the molten pool, the blow is done using the top-blown lance provided with the Laval nozzle having the exit diameter De(mm), which lies in the range that the ratio to the optimum exit diameter $De_o$(mm) ($De/De_o$) is not more than 0.95, the $De_o$ being obtained from the back pressure of the nozzle Poo(kPa), the ambient pressure Pe(kPa), and the throat diameter Dt(mm) according to the above formula (4); the Poo being determined such that it satisfies the above formula (3) with respect to the oxygen-flow-rate $Fh_M(Nm^3/hr)$ per hole of the Laval nozzle determined from the oxygen-flow-rate F ($Nm^3/hr$) in the low carbon region in the end of the blow and the throat diameter Dt(mm) of the Laval nozzle.

The oxygen blowing method in the converter according to the invention of the embodiment 1-4 is characterized in that; in either of the embodiment 1-1 through the embodiment 1-3, the top-blown lance has the multiple Laval nozzles, and at least one of those Laval nozzles satisfies the above conditions.

The oxygen blowing method in the converter according to the embodiment 1-5 is characterized in that; in either of the embodiment 1-1 through the embodiment 1-4, the amount of the slag within the converter is less than 50 kg per ton of the molten steel.

It is noted that the back pressures of the nozzle P, Po, Poo(kPa) and the ambient pressure Pe are those expressed in an absolute pressure (that is the pressure expressed regarding a vacuum state as a reference assuming the state is zero-pressure).

Figure 3:
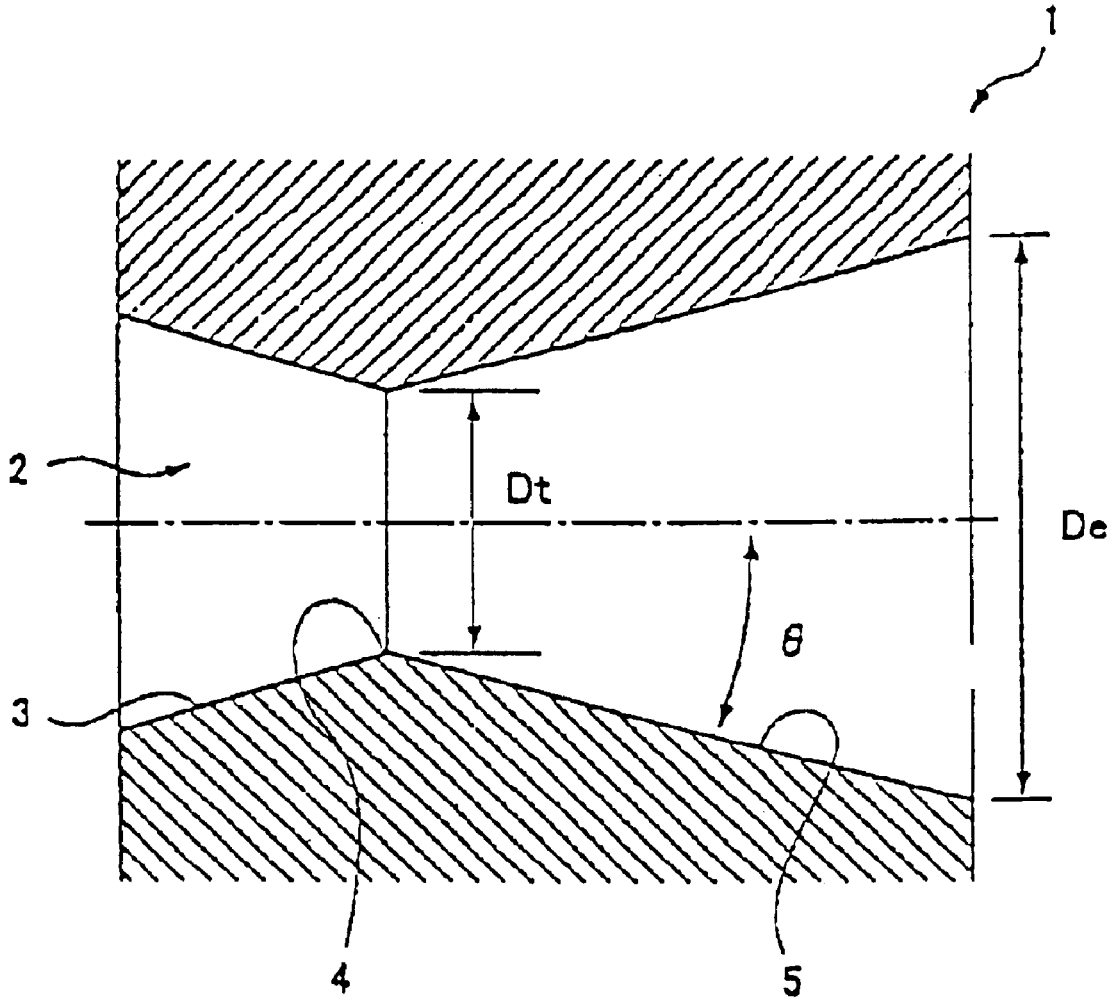
FIG. 3 is a schematic sectional view of the Laval nozzle used in this invention.

Hereinafter, the embodiments of the present invention will be described with reference to the drawings. FIG. 3 is the schematic sectional view of the Laval nozzle used in this invention, and as shown in FIG. 3, the Laval nozzle 2 is composed of two cones comprising a portion having a reducing section and the portion having an enlarging section, the portion having a reducing section is referred to as a reduction portion 3, the portion having an enlarging section is referred to as a skirt portion 5, and the narrowest region as the region transferred from the reduction portion 3 to the skirt portion 5 is referred to as the throat 4, with a single or multiple Laval nozzle or nozzles 2 being installed in a copper Lance nozzle 1.

The lance nozzle 1 is connected to the lower end of the lance body (not shown) by welding and the like to form the top-blown lance (not shown). The oxygen, which has passed through the inside of the lance body, is passed through the reduction portion 3, the throat 4, and the skirt portion 5 in order, and supplied into the converter as the ultrasonic or subsonic jet. In the figure, Dt is the throat diameter, De is the exit diameter, and a spreading angle θ of the skirt portion 5 is generally ten or less degrees.

It is noted that the reduction portion 3 and the skirt portion 5 are shown as the cones in the Laval nozzle 2 in FIG. 3, however, the reduction portion 3 and the skirt portion 5 are not always required to be cone for the Laval nozzle, and may be formed with a type of curved surface of which bore varies curvedly, in addition, the reduction portion 3 may possibly be a straight tubular type having the equal bore to that of the throat 4. In case the reduction portion 3 and the skirt portion 5 are formed with the type of the curved surface of which bore varies curvedly, although an ideal flow velocity distribution for the Laval nozzle can be obtained, the nozzle is machined extremely hard, while in case the reduction portion 3 is formed in the straight tubular type, although the ideal flow velocity distribution is a little bit distorted, it counts for nothing in use for the oxygen blowing and the nozzle is machined much easily. This invention refers to all of these divergent nozzles as the Laval nozzles.

This invention determines the shape of such formed Laval nozzle 2 according to the following procedures prior to the blow.

First, the oxygen-flow-rate $Fh_S(Nm^3/hr)$ in the single Laval nozzle 2 is given from the oxygen-flow-rate $F_S(Nm^3/hr)$ fed through the top-blown lance in the high carbon region in the peak of the decarburization. Herein, the high carbon region in the peak of the decarburization is the range that the carbon concentration in the molten pool is over 0.6 mass %, and the oxygen-flow-rate Fs is the rate in case the carbon region lies in this range, and when the oxygen-flow-rate is varied in the range that the carbon concentration is over 0.6 mass %, the rate is regarded to be any one of the varied oxygen-flow-rates. However, if the oxygen-flow-rate is varied differently in the range that the carbon concentration in the molten pool is over 0.6 mass %, a typical value or weighted mean value of those oxygen-flow-rates can be regarded to be the rate Fs.

The back pressure of the nozzle Po(kPa) is determined from the oxygen-flow-rate $Fh_S(Nm^3/hr)$ and the throat diameter Dt(mm) of the Laval nozzle 2 according to the aforementioned formula (1). Herein, the back pressure of the nozzle Po is the oxygen pressure within the lance body, or the pressure on an inlet side of the Laval nozzle 2. In this case, it is also permitted that the back pressure of the nozzle Po(kPa) in the high carbon region has been previously determined, and then the throat diameter Dt(mm) is determined from the oxygen-flow-rate $Fh_S$($Nm^3$/hr) and the back pressure of the nozzle Po(kPa).

Then, the exit diameter De(mm) is given using the back pressure of the nozzle Po(kPa), the ambient pressure Pe(kPa), and the throat diameter Dt(mm) determined in this manner according to the aforementioned formula (2). However, although the minimum value of the exit diameter De is not expressed in the formula (3), since the Laval nozzle 2 cannot keep its shape when the exit diameter De is smaller than the throat diameter Dt, the exit diameter De is established to be any one of values within the range according to the formula (2) under the condition that the De is more than or equal to the throat diameter Dt. Moreover, the ambient pressure Pe is the atmospheric pressure generally in the oxygen blowing.

When the exit diameter De is determined, it is preferable that following points are further considered to be determined. That is, it is preferable that the oxygen-flow-rate $Fh_M$($Nm^3$/hr) per Laval nozzle is given from the oxygen-flow-rate $F_M$($Nm^3$/hr) in the low carbon region in the end of the blow, the back pressure of the nozzle Poo(kPa) in the end of the blow is determined from the oxygen-flow-rate $Fh_M$ ($Nm^3$/hr) and the previously determined throat diameter Dt(mm) of the Laval nozzle according to the aforementioned formula (3), then the optimum exit diameter $De_o$(mm) in the end of the blow is given using the back pressure of the nozzle Poo(kPa), the ambient pressure Pe(kPa), and the throat diameter Dt(mm) according to the aforementioned formula (4), and the exit diameter De is determined within the range such that the ratio to the obtained optimum exit diameter $De_o$($De/De_o$) is not more than 1.10.

In this case, when the exit diameter De is determined within the range that the ratio ($De/De_o$) is not more than 0.95, in the general oxygen blowing in which the oxygen-flow-rate in the high carbon region is intentionally differed from the oxygen-flow-rate in the low carbon region, the exit diameter De satisfies the range according to the formula (2), therefore the range of the exit diameter De is not required to be positively determined. That is, when the ratio ($De/De_o$) is not more than 0.95, the exit diameter De can be determined from the oxygen-flow-rate $F_M$($Nm^3$/hr) in the low carbon region in the end of the blow.

Next, the lance nozzle 1 having the Laval nozzle 2 of which shape is determined in this manner is fabricated, and then connected to the lower end of the lance body to form the top-blown lance. When the lance nozzle 1 has the multiple Laval nozzles 2, only a part of those Laval nozzles 2 possibly has the shape determined as above. However, in this case, the intended effects are somewhat reduced.

Then, this top-blown lance is used to blow oxygen onto the molten iron, produced in a blast furnace and the like, in the converter. For the blow, in the high carbon region as the peak of the decarburization, the blow is done at the predetermined oxygen-flow-rate $F_S$, otherwise at any high oxygen-flow-rate corresponding to the refining reaction without regard to the oxygen-flow-rate $F_S$ when the oxygen-flow-rate is altered variously. On the other hand, in the low carbon region in the end of the blow, the blow is done at the reduced oxygen-flow-rate in order to improve the oxygen efficiency for the decarburization, in this case, the blow is preferably done under such conditions of the oxygen-flow-rate and the back pressure of the nozzle P that the ratio ($De/De_o$) to the optimum exit diameter Deo determined according to the formula (4) is 1.10 or less. However, the high and low carbon regions are not strictly classified at 0.6 mass % of the carbon concentration of the molten pool as a border, and the blow may be done even if the oxygen-flow-rate is reduced from the range of the carbon concentration of the molten pool over 0.6 mass %, or conversely even if the high oxygen-flow-rate is kept to the range of the carbon concentration below 0.6 mass %, for example about 0.4 mass % of the carbon concentration.

When the amount of the slag within the converter is small in the oxygen blowing, the percentage of the molten pool covered with the slag is reduced, and the amount of the dust and the scatter of the iron increases in the high carbon region. The above described blow method is much effective for restraining the dust and the scatter of the iron in the high carbon region. Also, in the low carbon region in the end of the blow, the factors for interfering the dynamic pressure of the jet decrease in case of the small amount of the slag, therefore the effect can be obtained in a broad control range. Accordingly, the refining method according to this invention can work more by applying the method to the blow where the amount of the slag within the converter is less than 50 kg, and desirably less than 30 kg, per ton of the molten steel.

By blowing oxygen onto the molten iron within the converter in this manner, the flow jet velocity during the high oxygen-flow-rate region in the high carbon region can be reduced, the oxygen jet energy is enabled to be kept in low order, the scatter of the iron and the dust can be reduced, and the jet flow velocity of the oxygen jet in the end of the blow can be optimized, or value of the dynamic pressure of the oxygen jet in the end of the blow can be increased close to the theoretical value, and then the oxidization of the iron can be restrained. Consequently, the yield of iron can be improved as a whole of the blow, and a stabilized operation is achieved.

EXAMPLE 1

About 250 tons of the molten iron were charged in the converter for the top and bottom blown combination blowing, which has a capacity of 250 tons, top-blows the oxygen, and bottom-blows agitation gas, then the decarburization blow was primarily performed. The used molten iron is that to which desulfurization and dephosphorization was applied with the pretreatment equipment for the molten iron as pre-converter process. Lime-based flux was added into the converter to generate the small amount of the slag (less than 50 kg per ton of the molten steel). Through a tuyere positioned in a bottom of the converter, argon or nitrogen was blown in about 10 $Nm^3$ per minute for agitating the molten pool.

The used top-blown lance is of a 5 holes-nozzle type with the five Laval nozzles installed therein, the throat diameter Dt of the Laval nozzle was established to be 55.0 mm, and the exit diameter De was determined from the oxygen-flow-rate Fs of 60000 $Nm^3$/hr in the peak of the decarburization ranging from the beginning to the middle of the blow. That is, the back pressure of the nozzle Po was determined to be 853 kPa (8.7 kgf/$cm^2$) from the conditions that the oxygen-flow-rate $Fh_S$ was 12000 $Nm^3$/hr and the throat diameter Dt was 55.0 mm according to the formula (1), and the exit diameter De was determined to be 61.5 mm from the conditions that the back pressure of the nozzle Po was 853 kPa, the ambient pressure was 101 kPa (the atmospheric pressure), and the throat diameter Dt was 55.0 mm according to the formula (5) assuming the constant k was 0.184. And then, the 5 holes-Laval nozzles were all formed like this.

The optimum back pressure of the nozzle Po, that is, the back pressure of the nozzle Po which brings the ideal expansion, was given from the conditions that the throat diameter Dt was 55.0 mm, the exit diameter De was 61.5 mm, and the ambient pressure was 101 kPa according to the formula (5) assuming the constant k was 0.259. As a result, the optimum back pressure of the nozzle Po was 428 kPa (4.4 kgf/cm$^2$).

On the basis of them, the oxygen was fed from the top-blown lance inserted within the converter under the conditions that the oxygen-flow-rate $F_S$ was 60000 Nm$^3$/hr and the back pressure of the nozzle Po was 853 kPa in the range from the beginning to the middle of the blow process as the peak of the decarburization, and the blow was done under the back pressure of the nozzle P of 428 kPa in the end of the blow where the carbon concentration of the molten pool was 0.6 mass % or less. In this case, since the back pressure of the nozzle P in the end of the blow is established to be agreed with the optimum back pressure of the nozzle Po, the ratio of the exit diameter De to the optimum exit diameter $De_o$ ($De/De_o$) is 1.0 in the end of the blow. The oxygen-flow-rate $F_M$ in the end of the blow was about 30000 Nm$^3$/hr under the back pressure of the nozzle P of 428 kPa.

The amount of the dust in the offgas was measured using the dry type dust-measuring device during the blow. Moreover, the slag within the converter was sampled when the blow was completed, and the T.Fe in the slag was examined. From the results of the blows over 100 heats, the amount of the dust was 8 kg per ton of the molten steel in the blow using the lance, and the T.Fe in the slag was 13 mass % when the blow was stopped at the carbon content of 0.05 mass %.

EXAMPLE 2

Using the same converter as that in the practical example 1, the molten iron, to which the pretreatment for the molten iron had been applied, was blown with the 5 holes-nozzles type top-blown lance under the same conditions as those in the practical example 1. However, regarding the shape of the Laval nozzle, while the throat diameter Dt was established to be 55.0 mm as with the practical example 1, the exit diameter De was altered.

That is, regarding the exit diameter De, the back pressure of the nozzle Po was determined to be 853 kPa (8.7 kgf/cm$^2$) according to the formula (1) from the conditions that the oxygen-flow-rate $Fh_S$ in the peak of the decarburization ranging from the beginning to the middle of the blow was 12000 Nm$^3$/hr and the throat diameter Dt was 55.0 mm, then the exit diameter De was established to be 58.2 mm according to the formula (5) assuming the constant K was 0.165 from the conditions that the back pressure of the nozzle Po was 853 kPa, the ambient pressure was 101 kPa (the atmospheric pressure), and the throat diameter Dt was 55.0 mm. And then, all of the 5 holes-Laval nozzles were formed like this.

The oxygen-flow-rate $F_M$ in the end of the blow was established to be about 30000 Nm$^3$/hr as with the example 1. Since the optimum exit diameter $De_o$ is given to be 61.5 mm from the practical example 1, the ratio of the exit diameter De to the optimum exit diameter $De_o$($De/De_o$) is 0.95.

On the basis of them, the oxygen was fed through the top-blown lance inserted within the converter under the conditions that the oxygen-flow-rate F was 60000 Nm$^3$/hr and the back pressure of the nozzle P was 853 kPa in the range from the beginning to the middle of the blow as the peak of the decarburization, and the blow was done under the back pressure of the nozzle P of 428 kPa in the end of the blow where the carbon concentration of the molten pool became 0.6 mass % or less.

The amount of the dust in the offgas was measured using the dry type dust-measuring device during the blow. Moreover, the slag within the converter was sampled when the blow was completed, and the T.Fe in the slag was examined. From the results of the blows over 100 heats, the amount of the dust was 7 kg per ton of the molten steel in the blow using this lance, and the T.Fe in the slag was 14 mass % when the blow was stopped at the carbon content of 0.05 mass %, and thus the significant effect for the dust reduction was found with substantially remaining the effect for the reduction of the T.Fe. Moreover, it was observed that the metal adhesion to the lance was extremely low in this occasion.

EXAMPLE 3

Using the same converter as that in the practical example 1, the molten iron, to which the pretreatment for molten iron had been applied, was blown with the 5 holes-nozzle type top-blown lance under the same conditions as those in the practical example 1 except for the amount of the slag. The lime-based flux was added into the converter to generate the small amount of the slag (less than 30 kg per ton of the molten steel). However, the shape of the Laval nozzle was determined from the oxygen-flow-rate $F_M$ in the end of the blow. That is, the exit diameter De of the Laval nozzle was determined under the conditions that the oxygen-flow-rate in the end of the blow was 30000 Nm$^3$/hr, the throat diameter Dt of the Laval nozzle was 56.0 mm, and the ratio of the exit diameter De to the optimum exit diameter $De_o$ ($De/De_o$) was 0.95 or less.

The back pressure of the nozzle Poo in the end of the blow was determined to be 411 kPa (4.2 kgf/cm$^2$) according to the formula (3) from the conditions that the oxygen-flow-rate $Fh_M$ in the end of the blow was 6000 Nm$^3$/hr and the throat diameter Dt was 56.0 mm, and the optimum exit diameter $De_o$ was given according to the formula (4) from the conditions that the back pressure of the nozzle Poo was 411 kPa, the ambient pressure was 101 kPa (the atmospheric pressure), and the throat diameter Dt was 56.0 mm, and then the optimum exit diameter, $De_o$=62.1 mm, was obtained. Therefore, the exit diameter De was established such that the ratio to the optimum exit diameter $De_o$ ($De/De_o$) was 0.94, and the exit diameter De was established to be 58.4 mm. All of the 5 holes-Laval nozzles were formed like this.

Using this top-blown lance, the oxygen was fed under the conditions that the oxygen-flow-rate $F_S$ was 60000 Nm$^3$/hr in the range from the beginning to the middle of the blow as the peak of the decarburization, and the blow was done under the conditions that the oxygen-flow-rate $F_M$ was 30000 Nm$^3$/hr and the back pressure of the nozzle P was 411 kPa in the end of the blow where the carbon concentration of the molten pool was 0.6 mass % or less. The back pressure of the nozzle P was about 823 kPa (8.4 kgf/cm$^2$) in the peak of the decarburization from the beginning to the middle of the blow where the oxygen-flow-rate $F_S$ was established to be 60000 Nm$^3$/hr.

The amount of the dust in the offgas was measured using the dry type dust-measuring device during the blow. Moreover, the slag within the converter was sampled when the blow was completed, and the T.Fe in the slag was examined. From the results of blows over 100 heats, the amount of the dust was 8 kg per ton of the molten steel in the blow using this lance, in addition, the T.Fe in the slag was 14 mass % when the blow was stopped at the carbon content of 0.05 mass %, and thus the significant effect for the dust reduction was found with substantially remaining the effect for the T.Fe reduction. Moreover, it was observed that the metal adhesion to the lance was extremely low in this occasion.

COMPARATIVE EXAMPLE

Using the same converter as that in the example 1, the molten iron, to which the pretreatment for molten iron had been applied, was blown with the 5 holes-nozzle type top-blown lance under the same conditions as those in the example 1. However, regarding the shape of the Laval nozzle, while the throat diameter Dt was established to be 55.0 mm as with the example 1, the exit diameter De was established such that the optimum expansion can be obtained in the peak of the decarburization. That is, the exit diameter De was established to be 73.0 mm according to the formula (5) assuming the constant k was 0.259 from the conditions that the back pressure of the nozzle Po was 853 kPa(8.7 kgf/cm$^2$), the ambient pressure Pe was 101 kPa (the atmospheric pressure), and the throat diameter Dt was 55.0 mm.

The blow was done with all of 5 holes Laval nozzles being formed like this, and the amount of the dust in the offgas was measured using the dry type dust-measuring device during the blow. Moreover, the slag within the converter was sampled when the blow was completed, and the T.Fe in the slag was examined. From the results of the blows over 100 heats, the amount of the dust was 14 kg per ton of the molten steel in the blow using this lance, in addition, the T.Fe in the slag was 19 mass % when the blow was stopped at the carbon content of 0.05 mass %, that is, both effects for the dust reduction and the T.Fe reduction were low compared with those in the practical examples.

What is claimed is:

1. A method for blowing oxygen into molten iron in a converter, in an oxygen refining process wherein oxygen is blown into the converter using a top-blown lance having a Laval nozzle installed at the tip of the top-blown lance, and wherein the Laval nozzle has a back pressure of the nozzle Po(kPa) satisfying the following formula with respect to a oxygen-flow-rate $Fh_S$(Nm$^3$/hr) per hole of the Laval nozzle determined from the oxygen-flow-rate $F_S$(Nm$^3$/hr) in a high carbon region in a peak of decarburization and a throat diameter Dt (mm), $$Po=Fh_S/(0.00465\cdot Dt^2)$$

the Laval nozzle has an exit diameter De satisfying the following formula with respect to the back pressure of the nozzle Po(kPa), an ambient pressure Pe(kPa), and said throat diameter Dt (mm):

$$De^2 \leqq 0.23\times Dt^2/\{(Pe/Po)^{5/7}\times[1-(Pe/Po)^{2/7}]\}.$$

2. The method according to claim 1, wherein said exit diameter De of the Laval nozzle satisfies the following formula with respect to the back pressure of the nozzle Po(kPa), the ambient pressure Pe(kPa), and said throat diameter Dt(mm):

$$De^2 \leqq 0.18\times Dt^2/\{(Pe/Po)^{5/7}\times[1-(Pe/Po)^{2/7}]^{1/2}\}.$$

3. The method according to claim 2, wherein said exit diameter De of the Laval nozzle satisfies the following formula with respect to the back pressure of the nozzle Po(kpa), the ambient pressure Pe(kPa), and said throat diameter Dt (mm):

$$0.15\times Dt^2/\{(Pe/Po)^{5/7}\times[1-(Pe/Po)^{2/7}]^{1/2}\} \leqq De^2 \leqq 0.18 Dt^2/\{(Pe/Po)^{5/7}\times[1-(Pe/Po)^{2/7}]^{1/2}\}.$$

4. The method according to claim 1, wherein said top-blown lance has multiple Laval nozzles, and at least one of those Laval nozzles satisfies conditions of the following two formulas:

$$Po=Fh_S/(0.00465\cdot Dt^2)$$

$$De^2 \leqq 0.23\times Dt^2/\{(Pe/Po)^{5/7}\times[1-(Pe/Po)^{2/7}]^{1/2}\}.$$

5. The method according to claim 4, wherein said top-blown lance has the multiple Laval nozzles, and at least one of those Laval nozzles satisfies the conditions of the following two formulas:

$$Po=Fh_S/(0.00465\cdot Dt^2)$$

$$De^2 \leqq 0.185\times Dt^2/\{(Pe/Po)^{5/7}\times 1-(Pe/Po)^{2/7}]^{1/2}\}.$$

6. The method according to any one of claims 1 to 5, wherein the oxygen blowing is carried out at an amount of slag of less than 50 kg per ton of molten steel.

7. The method according to claim 6, wherein the oxygen blowing is done at the amount of the slag of less than 30 kg per ton of the molten steel.

8. The method according to any one of claims 1 to 5, wherein said Laval nozzle has the back pressure of the nozzle Poo(kpa) satisfying the following formula with respect to the oxygen-flow-rate $Fh_M$(Nm$^3$/hr) per hole of the Laval nozzle determined from the oxygen-flow-rate $F_M$(Nm$^3$/hr) in the low carbon region in an end of the blow and said throat diameter Dt (mm), $$Poo=Fh_M/(0.00465\cdot Dt^2)$$

said exit diameter De has a ratio (De/De$_o$) of 1.10 or less to an optimum exit diameter De$_o$ (mm) obtained from the back pressure Poo(kPa), the ambient pressure Pe(kPa), and said throat diameter Dt(mm) according to the following formula:

$$De_o^2 \leqq 0.259\times Dt^2/\{(Pe/Poo)^{5/7}\times[1-(Pe/Poo)^{2/7}]^{1/2}\}.$$

9. A method for blowing oxygen into molten iron in a converter, in an oxygen refining process wherein oxygen is blown into the converter wherein said Laval nozzle has the back pressure of the nozzle Poo(kPa) satisfying the following formula with respect to the oxygen-flow-rate $Fh_M$(Nm$^3$/hr) per hole of the Laval nozzle determined from the oxygen-flow-rate $F_M$(Nm$^3$/hr) in the low carbon region in the end of the blow and the throat diameter Dt (mm), $$Poo=Fh_M/(0.00465\cdot Dt^2)$$

said exit diameter De of the Laval nozzle has the ratio (De/De$_o$) of 0.95 or less to the optimum exit diameter De$_o$(mm) obtained from the back pressure Poo(kPa), the ambient pressure Pe(kPa), and said throat diameter Dt(mm) according to the following formula:

$$De_o^2=0.259\times Dt^2/\{(Pe/Po)^{5/7}\times[1-(Pe/Poo)^{2/7}]^{1/2}\}.$$

10. The method according to claim 9, wherein said top-blown lance has the multiple Laval nozzles, and at least one of those Laval nozzles satisfies the conditions of the following two formulas:

$$Poo=Fh_M/(0.00465\cdot Dt^2)$$

$$De_o^2=0.259\times Dt^2/\{(Pe/Poo)^{5/7}\times[1-(Pe/Poo)^{2/7}]^{1/2}\}.$$

11. The method according to claim 9, wherein the oxygen blowing is carried out at the amount of the slag less than 50 kg per ton of the molten steel.

12. The method according to claim 11, wherein the oxygen blowing is done at the amount of the slag less than 30 kg per ton of the molten steel.

13. A top-blown lance for blowing oxygen in a converter, the top-blown lance having the Laval nozzle installed on the tip, characterized in that said Laval nozzle has the back pressure of the nozzle Po(kPa) satisfying the following formula with respect to the oxygen-flow-rate $Fh_S$($Nm^3$/hr) per hole of the Laval nozzle determined from the oxygen-flow-rate $F_S$($Nm^3$/hr) in the high carbon region in the peak of the decarburization and the throat diameter Dt(mm), $$Po=Fh_S/(0.00465\cdot Dt^2)$$

the exit diameter De of the Laval nozzle satisfies the following formula with respect to the back pressure of the nozzle Po(kpa), the ambient pressure Pe(kPa), and said throat diameter Dt (mm):

$$De^2\leqq 0.23\times Dt^2/\{(Pe/Po)^{5/7}\times[1-(Pe/Po)^{2/7}]^{1/2}\}.$$

14. A top-blown lance for blowing oxygen in a converter, the top-blown lance having the Laval nozzle installed on the tip, characterized in that said Laval nozzle has the back pressure of the nozzle Poo(kPa) satisfying the following formula with respect to the oxygen-flow-rate $Fh_x$ ($Nm^3$/hr) per hole of the Laval nozzle determined from the oxygen-flow-rate $F_M$($Nm^3$/hr) in the low carbon region in the end of the blow and the throat diameter Dt(mm), $$Poo=Fh_M/(0.00465\cdot Dt^2)$$

said exit diameter De of the Laval nozzle has the ratio ($De/De_o$) of 0.95 or less to the optimum exit diameter $De_o$(mm) obtained from the back pressure Poo(kpa), the ambient pressure Pe(kPa), and said throat diameter Dt(mm) according to the following formula:

$$De_o^2=0.259\times Dt^2/\{(Pe/Poo)^{5/7}\times[1-(Pe/Poo)^{2/7}]^{1/2}\}.$$

15. The method according to claim 6, wherein said Laval nozzle has the back pressure of the nozzle Poo(kPa) satisfying the following formula with respect to the oxygen-flow-rate $Fh_M$($Nm^3$/hr) per hole of the Laval nozzle determined from the oxygen-flow-rate $F_M$($Nm^3$/hr) in the low carbon region in an end of the blow and said throat diameter Dt(mm), $$Poo=Fh_M/(0.00465\cdot Dt^2)$$

said exit diameter De has a ratio ($De/De_o$) of 0.10 or less to an optimum exit diameter $De_o$(mm) obtained from the back pressure Poo(kPa), the ambient pressure Pe(kpa), and said throat diameter Dt(mm) according to the following formula:

$$De_o^2=0.259\times Dt^2/\{[(Pe/Poo)^{5/7}\times[1-(Pe/Poo)^{2/7}]^{1/2}\}.$$

16. The method according to claim 7, wherein said Laval nozzle has the back pressure of the nozzle Poo(kPa) satisfying the following formula with respect to the oxygen-flow-rate $Fh_M$($Nm^3$/hr) per hole of the Laval nozzle determined from the oxygen-flow-rate $F_M$($Nm^3$/hr) in the low carbon region in an end of the blow and said throat diameter Dt(mm), $$Poo=Fh_M/(0.0046\cdot Dt^2)$$

said exit diameter De has a ratio ($De/De_o$) of 0.10 or less to an optimum exit diameter $De_o$(mm) obtained from the back pressure Poo(kPa), the ambient pressure Pe(kPa), anti said throat diameter Dt(mm) according to the following formula:

$$De_o^2=0.259\times Dt^2/\{(Pe/Poo)^{5/7}\times[1-(Pe/Poo)^{2/7}]^{1/2}\}.$$

* * * * *